US008123832B2

(12) United States Patent
Kato et al.

(10) Patent No.: US 8,123,832 B2
(45) Date of Patent: Feb. 28, 2012

(54) R-T-B SYSTEM SINTERED MAGNET

(75) Inventors: Eiji Kato, Tokyo (JP); Chikara Ishizaka, Tokyo (JP)

(73) Assignee: TDK Corporation, Tokyo (JP)

( * ) Notice: Subject to any disclaimer, the term of this patent is extended or adjusted under 35 U.S.C. 154(b) by 317 days.

(21) Appl. No.: 11/814,105

(22) PCT Filed: Mar. 8, 2006

(86) PCT No.: PCT/JP2006/304509

§ 371 (c)(1),
(2), (4) Date: Jul. 17, 2007

(87) PCT Pub. No.: WO2006/098204

PCT Pub. Date: Sep. 21, 2006

(65) Prior Publication Data

US 2009/0019969 A1 Jan. 22, 2009

(30) Foreign Application Priority Data

Mar. 14, 2005 (JP) ..... 2005-70414

(51) Int. Cl.
*B22F 1/00* (2006.01)
*B22F 3/00* (2006.01)
*C22C 1/00* (2006.01)

(52) U.S. Cl. ..... 75/228; 148/302

(58) Field of Classification Search ..... 75/228; 148/302; 420/83; *B22F 1/00, 3/00; C22C 1/00*
See application file for complete search history.

(56) References Cited

U.S. PATENT DOCUMENTS 5,034,146 A 7/1991 Ohashi et al.
5,405,455 A 4/1995 Kusunoki et al.
2003/0172995 A1 * 9/2003 Makita et al. ..... 148/101
(Continued)

FOREIGN PATENT DOCUMENTS

EP 0 237 416 A1 9/1987
(Continued)

OTHER PUBLICATIONS

European Search Report dated Jul. 22, 2010 of European Patent Application No. 06728778.9.

*Primary Examiner* — Jessica L Ward
*Assistant Examiner* — Alexander Polyansky
(74) *Attorney, Agent, or Firm* — Pearne & Gordon LLP

(57) ABSTRACT

An R-T-B system sintered magnet is provided which achieves both a high residual magnetic flux density and a high coercive force. The R-T-B system sintered magnet comprises main-phase grains 1 each having a core-shell structure comprising an inner shell part 2 and an outer shell part 3 surrounding the inner shell part 2, wherein the concentration of the heavy rare earth element in the inner shell part 2 is lower by 10% or more than the concentration of the heavy rare earth element in the periphery of the outer shell part 3, and $(L/r)_{ave}$ falls within a range from 0.03 to 0.40 in the main-phase grains 1 each comprising the inner shell part 2 and the outer shell part 3, wherein L represents the shortest distance from the periphery of the main phase grain 1 to the inner shell part 2, r represents the equivalent diameter of the main phase grain 1, and $(L/r)_{ave}$ represents the average value of L/r for the main-phase grains 1 present in the sintered body and having the core-shell structure.

7 Claims, 5 Drawing Sheets

U.S. PATENT DOCUMENTS

| | | | | |
|---|---|---|---|---|
| 2004/0050454 | A1 | 3/2004 | Sekino et al. | |
| 2004/0189426 | A1 * | 9/2004 | Hidaka et al. | 335/202 |
| 2005/0098238 | A1 * | 5/2005 | Morimoto et al. | 148/302 |

FOREIGN PATENT DOCUMENTS

| | | | | |
|---|---|---|---|---|
| EP | 0251871 | A2 | | 1/1988 |
| EP | 0395625 | A2 | | 10/1990 |
| EP | 1365422 | A1 | | 11/2003 |
| JP | 05-10806 | B2 | | 2/1993 |
| JP | 06-096928 | | * | 4/1994 |
| JP | 06-096928 | A | | 4/1994 |
| JP | 07-057913 | A | | 3/1995 |
| JP | 07-122413 | A | | 5/1995 |
| JP | 09-232173 | A | | 9/1997 |
| JP | 2000-188213 | A | | 7/2000 |
| JP | 2002-299110 | A | | 10/2002 |
| JP | 2002-356701 | A | | 12/2002 |
| JP | 2002356701 | A | * | 12/2002 |
| JP | 2005-011973 | A | | 1/2005 |
| WO | 02/061769 | A1 | | 8/2002 |
| WO | 2004/886683 | A1 | | 10/2004 |
| WO | 2005/001856 | A1 | | 1/2005 |

* cited by examiner

R-T-B SYSTEM SINTERED MAGNET

TECHNICAL FIELD

The present invention relates to an R-T-B (R represents one or more rare earth elements inclusive of Y (yttrium), T represents one or more transition metal elements wherein Fe or Fe and Co are essential, and B represents boron) system sintered magnet.

BACKGROUND ART

Among rare earth permanent magnets, R-T-B system sintered magnets have been used in various electric devices because the R-T-B system sintered magnets are excellent in magnetic properties, and Nd as the main component thereof is abundant as a source and relatively inexpensive. However, such R-T-B system sintered magnets with excellent magnetic properties also suffer from several technical problems to be solved. Among such problems is a fact that the R-T-B system sintered magnets are low in thermal stability, and hence undergo remarkable coercive force decrease brought about by temperature elevation. Accordingly, Patent Document 1 (Japanese Patent Publication No. 5-10806) has proposed that the coercive force at room temperature is enhanced by adding a heavy rare earth element typified by Dy, Tb or Ho, so as to enable the coercive force to be maintained to a level ensuring the use of the R-T-B system sintered magnets without trouble even when the coercive force is decreased by temperature elevation. The $R_2T_{14}B$ compounds using these heavy rare earth elements are higher in anisotropic magnetic field than the $R_2T_{14}B$ compounds using light rare earth elements such as Nd and Pr, and can attain a high coercive force.

An R-T-B system sintered magnet comprises a sintered body at least comprising main phase grains comprising an $R_2T_{14}B$ compound and a grain boundary phase containing R in a larger content than the main phase. A proposal on the optimal concentration distribution of the heavy rare earth element in the main phase grains, having significant effects on the magnetic properties, and on the controlling method of the optimal concentration distribution is disclosed in Patent Document 2 (Japanese Patent Laid-Open No. 7-122413) and Patent Document 3 (Japanese Patent Laid-Open No. 2000-188213).

Patent Document 2 has proposed that in a rare earth permanent magnet comprising, as the configuration phases thereof, a main phase mainly comprising the $R_2T_{14}B$ grains (R represents one or more rare earth elements, and T represents one or more transition metals) and an R rich phase (R represents one or more rare earth elements), a heavy rare earth element is made to distribute so as to be high in concentration at least at three points in the $R_2T_{14}B$ grains. The R-T-B system sintered magnet of Patent Document 2 is disclosed to be obtained as follows: an R-T-B system alloy comprising $R_2T_{14}B$ as the configuration phase thereof and an R-T system alloy in which the area proportion of R-T eutectics containing at least one heavy rare earth element is 50% or less are pulverized separately and mixed together, and the mixture thus prepared is compacted and sintered to yield the R-T-B system sintered magnet. The R-T-B system alloy preferably comprises the $R_2T_{14}B$ grains as the configuration phase thereof and is recommended to have a composition in which 27 wt %≦R≦30 wt %, 1.0 wt %≦B≦1.2 wt % and the balance is composed of T.

Additionally, Patent Document 3 discloses that an R-T-B system sintered magnet having microstructures containing first $R_2T_{14}B$ type main phase grains higher in the concentration of a heavy rare earth element than the grain boundary phase and second $R_2T_{14}B$ type main phase grains lower in the concentration of the heavy rare earth element than the grain boundary phase has a high residual magnetic flux density and a high value of the maximum energy product.

For the purpose of obtaining the above-described microstructures, Patent Document 3 adopts a so-called mixing method in which two or more R-T-B system alloy powders different in the content of the heavy rare earth element such as Dy are mixed together. In this case, the composition of each of the R-T-B system alloy powders is regulated in such a way that the total content of the R elements is the same in each of the alloy powders. For example, in the case of Nd+Dy, one of the alloy powders is set to have a composition of 29.0% Nd+1.0% Dy and the other of the alloy powders is set to have a composition of 15.0% Nd+15.0% Dy. Additionally, it is described that preferably the contents of the elements other than the R elements in the individual alloy powders are substantially the same.

Patent Document 1: Japanese Patent Publication No. 5-10806

Patent Document 2: Japanese Patent Laid-Open No. 7-122413

Patent Document 3: Japanese Patent Laid-Open No. 2000-188213

DISCLOSURE OF THE INVENTION

Problems to Be Solved by the Invention

With the R-T-B system sintered magnet according to Patent Document 2, a coercive force (iHc) of approximately 14 kOe can be obtained, and accordingly, a further improvement of the coercive force is desired.

Additionally, the proposal disclosed in Patent Document 3 is a technique effective in improving the residual magnetic flux density and the maximum energy product of an R-T-B system sintered magnet. However, with this technique, the coercive force is hardly obtainable, and accordingly, it is difficult to achieve both a high residual magnetic flux density and a high coercive force.

The present invention has been achieved on the basis of such technical problems as described above, and an object of the present invention is to provide an R-T-B system sintered magnet capable of achieving both a high residual magnetic flux density and a high coercive force.

Means for Solving the Problems

For the purpose of achieving the above-mentioned object, the R-T-B system sintered magnet of the present invention comprises a sintered body comprising, as a main phase of the sintered body, grains mainly comprising an $R_2T_{14}B$ compound and comprising at least one of Dy and Tb as a heavy rare earth element and at least one of Nd and Pr as a light rare earth element, the R-T-B system sintered magnet being characterized in that: the sintered body comprises the grains each having a core-shell structure comprising an inner shell part and an outer shell part surrounding the inner shell part; the concentration of the heavy rare earth element in the inner shell part is lower by 10% or more than the concentration of the heavy rare earth element in the periphery of the outer shell part; and in the grains each comprising the inner shell part and the outer shell part, $(L/r)_{ave}$ falls within a range from 0.03 to 0.40; wherein: R represents one or more rare earth elements inclusive of Y; T represents one or more transition metal elements wherein Fe or Fe and Co are essential; L represents the shortest distance from the periphery of the grain to the inner shell part; r represents the equivalent diameter of the grain; and $(L/r)_{ave}$ represents the average value of L/r for the grains present in the sintered body and having the core-shell structure.

In the R-T-B system sintered magnet of the present invention, $(L/r)_{ave}$ is preferably 0.06 to 0.30, and more preferably 0.10 to 0.25.

In the R-T-B system sintered magnet of the present invention, the concentration of the heavy rare earth element in the inner shell part is preferably 20 to 95% of the concentration of the heavy rare earth element in the periphery of the outer shell part; the concentration of the heavy rare earth element in the inner shell part is more preferably 20 to 70%, and furthermore preferably 20 to 50% of the concentration of the heavy rare earth element in the periphery of the outer shell part.

Additionally, in the R-T-B system sintered magnet of the present invention, in order for the above-mentioned sintered magnet to achieve both a high residual magnetic flux density and a high coercive force, in a section thereof, the proportion of the number of the grains each having the core-shell structure to the total number of the grains forming the sintered body is preferably 20% or more; the proportion of the number of the grains each having the core-shell structure to the total number of the grains forming the sintered body is more preferably 30 to 60%. Alternatively, when the squareness ratio is regarded as important, the proportion of the number of the grains each having the core-shell structure to the total number of the grains forming the sintered body is preferably 60 to 90%.

The R-T-B system sintered magnet of the present invention contains a light rare earth element; the light rare earth element preferably has a concentration higher in the inner shell part than in the periphery of the outer shell part.

Additionally, in the R-T-B system sintered magnet of the present invention, the sintered body preferably has a composition comprising R: 25 to 37 wt %, B: 0.5 to 2.0 wt %, Co: 3.0 wt % or less, and the balance: Fe and inevitable impurities, wherein R contains the heavy rare earth element in an amount of 0.1 to 10 wt %.

Advantage of the Invention

According to the present invention, an R-T-B system sintered magnet can be provided which achieves both a high residual magnetic flux density and a high coercive force.

DESCRIPTION OF SYMBOLS

1 . . . Main phase grain, 2 . . . Inner shell part, 3 . . . Outer shell part

BEST MODE FOR CARRYING OUT THE INVENTION

<Microstructures>

The R-T-B system sintered magnet of the present invention comprises a sintered body at least comprising main phase grains comprising $R_2T_{14}B$ grains (R represents one or more rare earth elements inclusive of Y, T represents one or more transition metal elements wherein Fe or Fe and Co are essential, and B represents boron) and a grain boundary phase containing R in a larger content than the main phase grains. Included among the main phase grains are the main phase grains each having a structure comprising an inner shell part and an outer shell part surrounding the inner shell part.

Here, the inner shell part and the outer shell part are identified on the basis of the concentration of the heavy rare earth element. In other words, the inner shell part is lower in the concentration of the heavy rare earth element than the outer shell part.

Figure 1:
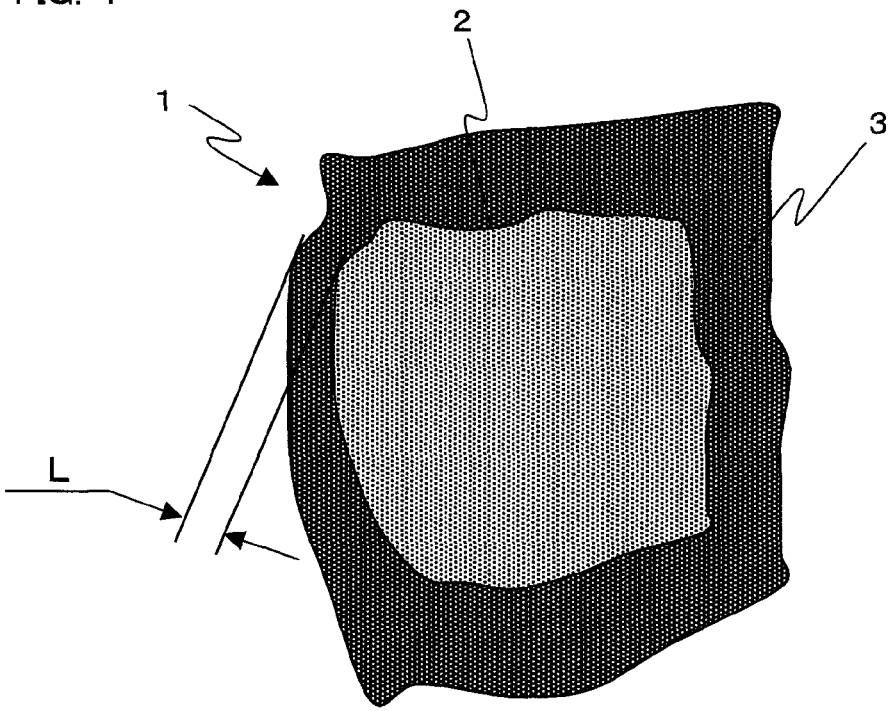
FIG. 1 is a view schematically illustrating a main phase grain of the present invention, having an inner shell part and an outer shell part.
Figure 2:
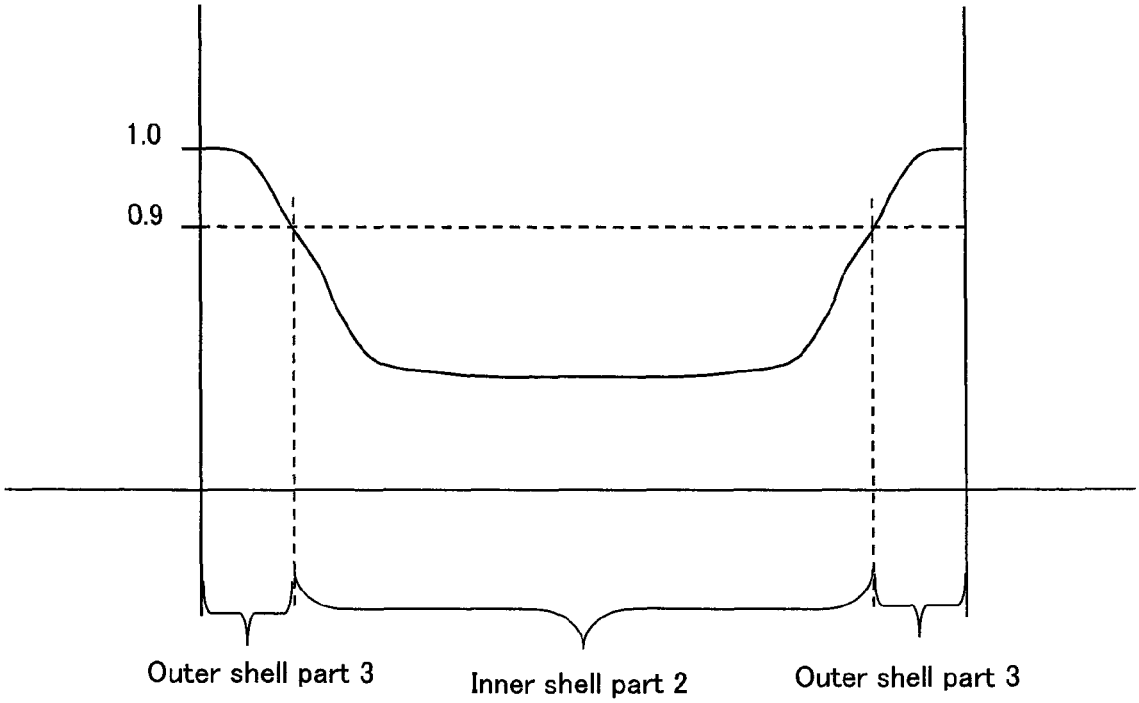
FIG. 2 is a view schematically illustrating an example of the concentration distribution of a heavy rare earth element (for example, Dy) in a main phase grain according to the present invention.

FIG. 1 schematically illustrates the main phase grain 1 having the inner shell part 2 and the outer shell part 3. As shown in FIG. 1, the outer shell part 3 surrounds the inner shell part 2. The inner shell part 2 is lower in the concentration of the heavy rare earth element as compared to the outer shell part 3. FIG. 2 schematically illustrates the concentration distribution of the heavy rare earth element (for example, Dy) in the main phase grain 1; the horizontal axis represents the direction of the longitudinal-section width of the main phase grain and the vertical axis represents the concentration of the heavy rare earth element. In the main phase grain 1, with the concentration of the heavy rare earth element in the periphery thereof as a reference, the part in which the decrease of the concentration of the heavy rare earth element is less than 10% is defined as the outer shell part 3, and the part in which the decrease of the heavy rare earth element concentration is 10% or more is defined as the inner shell part 2. In FIG. 2, the part which has the concentration of the heavy rare earth element falling within a range from 1.0 to 0.9 constitutes the outer shell part 3, and the part which is surrounded by the outer shell part 3 and has the concentration of the heavy rare earth element of 0.9 or less constitutes the inner shell part 2.

In the main phase grain 1 comprising the inner shell part 2 and the outer shell part 3, the outer shell part 3 is required to be formed in a region from the surface of the main phase grain 1 to a predetermined depth. In other words, the present invention is characterized in that $(L/r)_{ave}$ falls within a range from 0.03 to 0.40. As shown in FIG. 1, L represents the shortest distance from the periphery of the main phase grain 1 to the inner shell part 2, and r represents the equivalent diameter of the main phase grain 1. Here, the equivalent diameter means the diameter of a circle that has the same area as the projected area of the main phase grain 1. Accordingly, L/r=0.03 means that the outer shell part 3 occupies the region ranging from the surface of the main phase grain 1 virtually assumed to be a circle to the depth of 3% of the diameter of the main phase grain 1. Additionally, L/r=0.40 means that the outer shell part 3 occupies the region ranging from the surface of the main phase grain 1 virtually assumed to be a circle to the depth of 40% of the diameter of the main phase grain 1. The $(L/r)_{ave}$ is the average value of the (L/r) values of the main-phase grains 1, present in the sintered body, each comprising the inner shell part 2 and the outer shell part 3. The $(L/r)_{ave}$ in the present invention is defined as the value evaluated on the basis of the computation method described in Examples to be described below.

It is to be noted that the improvement of the coercive force requires that the anisotropic magnetic field of the main phase grain 1 be high. The anisotropic magnetic field is varied depending on the selected rare earth element(s). In other words, an $R_2T_{14}B$ compound using a heavy rare earth element is higher in anisotropic magnetic field than an $R_2T_{14}B$ compound using a light rare earth element. Accordingly, when only the coercive force is considered, an R-T-B system sintered magnet has only to comprise main-phase grains 1 exclusively comprising an $R_2T_{14}B$ compound using a heavy rare earth element. However, such an R-T-B system sintered magnet has the following problems. Specifically, an $R_2T_{14}B$ compound using a heavy rare earth element is low in saturation magnetization and is thus unfavorable from the viewpoint of the residual magnetic flux density. Therefore, in the present invention, the outer shell part 3 is made to be a region high in the concentration of the heavy rare earth element as described above, and the anisotropic magnetic field in this region is thereby improved to ensure a high coercive force.

The main phase grain 1 contains, in addition to the heavy rare earth element, a light rare earth element typified by Nd or Pr. An $R_2T_{14}B$ compound using a light rare earth element is higher in saturation magnetization than an $R_2T_{14}B$ compound using a heavy rare earth element. The concentration of R as the whole $R_2T_{14}B$ compound is essentially uniform, and the inner shell part 2 is lower in the concentration of the heavy rare earth element. Therefore, the concentration of the light rare earth element is higher in the inner shell part 2 than in the outer shell part 3, and thus the inner shell part 2 is improved in saturation magnetization and a high residual magnetic flux density can be attained.

As described above, the main-phase grain 1 of the present invention can have a region (the inner shell part 2) having a high residual magnetic flux density and a region (the outer shell part 3) having a high coercive force.

In the present invention, when $(L/r)_{ave}$ is less than 0.03, the region higher in the concentration of the heavy rare earth element becomes insufficient, and the coercive force (HcJ) value is thereby decreased. On the other hand, when $(L/r)_{ave}$ exceeds 0.40, the inner shell part 2 becomes too small, and the residual magnetic flux density (Br) is decreased. Accordingly, in the present invention, $(L/r)_{ave}$ is set at 0.03 to 0.40; $(L/r)_{ave}$ is preferably 0.06 to 0.30, and more preferably 0.10 to 0.25.

In the present invention, the coercive force and the residual magnetic flux density are varied depending on the ratio of the heavy rare earth element proportion in the inner shell part 2 to the heavy rare earth element proportion in the outer shell part 3. Specifically, when the concentration of the heavy rare earth element in the inner shell part 2 is low, and the heavy rare earth element concentration difference between the inner shell part 2 and the outer shell part 3 becomes large, the residual magnetic flux density becomes low. On the contrary, when the concentration of the heavy rare earth element in the inner shell part 2 is high, and the heavy rare earth element concentration difference between the inner shell part 2 and the outer shell part 3 becomes small, the coercive force becomes low. Therefore, in the present invention which achieves both a coercive force and a residual magnetic flux density, the concentration of the heavy rare earth element in the center of the inner shell part 2 is preferably 20 to 95% of the concentration of the heavy rare earth element in the periphery of the outer shell part 3. For the purpose of achieving both a coercive force and a residual magnetic flux density at the same time, the concentration of the heavy rare earth element in the inner shell part 2 is preferably set at 20 to 70% of the concentration of the heavy rare earth element in the periphery of the outer shell part 3; and the concentration of the heavy rare earth element in the inner shell part 2 is more preferably set at 20 to 50% of the concentration of the heavy rare earth element in the periphery of the outer shell part 3.

In the present invention, it is not necessary that all the main phase grains be the main phase grains 1 each comprising the inner shell part 2 and the outer shell part 3; however, for the purpose of enjoying the above-mentioned advantageous effects, the main phase grains 1 each comprising the inner shell part 2 and the outer shell part 3 should be present in a certain proportion in the sintered body. Specifically, in a section of the sintered body, the proportion of the number of the main phase grains 1 each having the structure shown in FIG. 1 to the number of the main phase grains forming the sintered body is preferably 20% or more. When the proportion is less than 20%, the proportion of the main phase grains 1 having the structure serving as a factor for improving the residual magnetic flux density (Br) is small, and hence the improvement effect of the residual magnetic flux density (Br) becomes small. From the viewpoint of achieving both the residual magnetic flux density (Br) and the coercive force (HcJ), the proportion of the number of the main phase grains 1 each having the core-shell structure is set at 30 to 60%. It is to be noted that in the present invention, this proportion is defined as the value evaluated on the basis of the computation method described in Examples to be described below.

The proportion of the main phase grains 1 affects the squareness ratio of the R-T-B system sintered magnet although the reason for that is not clear yet. In other words, when the number of the main phase grains 1 in the present invention each having the inner shell part 2 and the outer shell part 3 is increased, the squareness ratio can be improved. When the squareness ratio is also considered, the proportion of the main phase grains 1 is preferably 40% or more, and more preferably 60 to 90%.

<Chemical Composition>

Next, description will be made on the preferable chemical composition of the R-T-B system sintered magnet of the present invention. The chemical composition as referred to herein means the chemical composition after sintering.

The R-T-B system sintered magnet of the present invention contains one or more rare earth elements (R) in a content of 25 to 37 wt %.

Here, R in the present invention has a concept including Y (yttrium). Accordingly, R in the present invention represents one or more elements selected from Y (yttrium), La, Ce, Pr, Nd, Sm, Eu, Gd, Tb, Dy, Ho, Er, Tm, Yb and Lu.

When the content of R is less than 25 wt %, the generation of an $R_2T_{14}B$ phase as a main phase of the R-T-B system sintered magnet is not sufficient, and α-Fe or the like having soft magnetic properties is segregated to remarkably decrease the coercive force. On the other hand, when the content of R exceeds 37 wt %, the volume ratio of the $R_2T_{14}B$ phase as a main phase is decreased, and the residual magnetic flux density is decreased. Moreover, when the content of R exceeds 37 wt %, R reacts with oxygen to increase the content of the contained oxygen, and accordingly the R rich phase effective in generating the coercive force is decreased in its content to cause the decrease of the coercive force. Therefore, the content of R is set at 25 to 37 wt %; the content of R is preferably 28 to 35 wt % and more preferably 29 to 33 wt %. It is to be noted that the content of R as referred to herein contains a heavy rare earth element.

Because Nd and Pr are abundant as sources and relatively inexpensive, Nd and Pr are preferably selected as the main components of R. In addition, the R-T-B system sintered magnet of the present invention contains a heavy rare earth element, for the purpose of improving the coercive force. It is to be noted that the heavy rare earth element in the present invention means one or more of Tb, Dy, Ho, Er, Tm, Yb and Lu. Among these, at least one of Dy and Tb is most preferably contained. Accordingly, at least one of Nd and Pr as R and at least one of Dy and Tb also as R are selected, and the total content of the thus selected elements is set at 25 to 37 wt % and preferably 28 to 35 wt %. Within these ranges, the content of at least one of Dy and Tb is preferably set at 0.1 to 10 wt %. The content of at least one of Dy and Tb can be determined within the above-mentioned ranges depending on which of the residual magnetic flux density and the coercive force is regarded as important. Specifically, when a high residual magnetic flux density is desired, the content of at least one of Dy and Tb may be set at a low value of 0.1 to 4.0 wt %, and when a high coercive force is desired, the content of at least one of Dy and Tb may be set at a high value of 4.0 to 10 wt %.

Additionally, the R-T-B system sintered magnet of the present invention contains boron (B) in a content of 0.5 to 2.0 wt %. When the content of B is less than 0.5 wt %, no high coercive force can be obtained. On the other hand, when the content of B exceeds 2.0 wt %, the residual magnetic flux density tends to be decreased. Accordingly, the upper limit of the content of B is set at 2.0 wt %. The content of B is preferably 0.5 to 1.5 wt % and more preferably 0.8 to 1.2 wt %.

The R-T-B system sintered magnet of the present invention can contain one or two of Al and Cu within a content range from 0.02 to 0.5 wt %. The containment of one or two of Al and Cu within this range makes it possible to achieve a high coercive force, a strong corrosion resistance and an improved temperature properties of the R-T-B system sintered magnet to be obtained. When Al is added, the content of Al is preferably 0.03 to 0.3 wt % and more preferably 0.05 to 0.25 wt %. When Cu is added, the content of Cu is preferably 0.01 to 0.15 wt % and more preferably 0.03 to 0.12 wt %.

The R-T-B system sintered magnet of the present invention can contain Co in a content of 3.0 wt % or less, preferably 0.1 to 2.0 wt % and more preferably 0.3 to 1.5 wt %; Co forms a phase similar to that of Fe, and is effective in improving the Curie temperature and the corrosion resistance of the grain boundary phase.

The R-T-B system sintered magnet of the present invention allows the containment of other elements. For example, Zr, Ti, Bi, Sn, Ga, Nb, Ta, Si, V, Ag, Ge and others can be appropriately contained. On the other hand, it is preferable to reduce the contents of the impurities such as oxygen, nitrogen and carbon to the minimum. Among others, oxygen that impairs the magnetic properties is preferably reduced in the content thereof so as to be 5000 ppm or less; this is because when the oxygen content is large, the rare earth oxide phase that is a nonmagnetic component grows to degrade the magnetic properties.

<Production Method>

The R-T-B system sintered magnet of the present invention can be produced by using, as a mixture, two or more raw material alloys different from each other in the heavy rare earth element content.

In this case, at least two R-T-B alloys each mainly comprising an $R_2T_{14}B$ compound may be prepared, and the heavy rare earth element contents of the two R-T-B alloys may be made to be different from each other; examples of such sets of alloys may include the following examples (1) and (2). Alternatively, an R-T-B alloy mainly comprising an $R_2T_{14}B$ compound and an R-T alloy comprising no $R_2T_{14}B$ compound may be used; examples of such sets of alloys may include the following (3). Here, it is to be noted that the following (1) to (3) exclusively serve as examples, but by no means limit the present invention.

(1) Two or more R-T-B alloys different from each other in the heavy rare earth element content are mixed. Except for the heavy rare earth element contents, the compositions of these alloys are the same (% means wt %).
Specific examples:

31% Nd-0% Dy-2% Co-0.1% Cu-1.0% B-bal.Fe

26% Nd-5% Dy-2% Co-0.1% Cu-1.0% B-bal.Fe (2) Two or more R-T-B alloys different from each other in the heavy rare earth element content are mixed. The compositions of these alloys are the same in the total rare earth content (Nd+Pr+the heavy rare earth element), but are different in the heavy rare earth element content, the Co content, the B content and the like (% means wt %).
Specific examples:

31% Nd-0% Dy-0% Co-0.2% Cu-1.2% B-bal.Fe

26% Nd-20% Dy-5% Co-0.2% Cu-0.8% B-bal.Fe (3) An R-T-B alloy and an R-T alloy are used as a mixture (% means wt %).
Specific examples:

31% Nd-0% Dy-0% Co-0.1% Cu-1.3% B-bal.Fe

5% Nd-40% Dy-10% Co-0.1% Cu-0% B-bal.Fe

The R-T-B alloy and the R-T alloy can be prepared by means of strip casting or other known dissolution methods in vacuum or in an atmosphere of an inert gas, preferably Ar.

The R-T-B alloy contains, as the constituent elements thereof, Cu and Al in addition to the rare earth elements, Fe, Co and B. The chemical composition of the R-T-B alloy is appropriately determined according to the chemical composition of the R-T-B system sintered magnet desired to be finally obtained; preferably the chemical composition range is set to be such that 25 to 40 wt % R-0.8 to 2.0 wt % B-0.03 to 0.3 wt % Al-bal.Fe. When two or more R-T-B alloys different from each other in the heavy rare earth element content are used, the heavy rare earth element contents thereof are preferably different from each other by 5 wt % or more (for example, combinations of 0% and 5%, and 2% and 8%).

Additionally, the R-T alloy can also contain Cu and Al in addition to the rare earth element(s), Fe and Co. The chemical composition of the R-T alloy is appropriately determined according to the chemical composition of the R-T-B system sintered magnet desired to be finally obtained; preferably the chemical composition range is set to be such that 26 to 70 wt % R-0.3 to 30 wt % Co-0.03 to 5.0 wt % Cu-0.03 to 0.3 wt % Al-bal.Fe. For the purpose of obtaining the above-described structure of the present invention, the rare earth element to be contained in the R-T alloy is preferably the heavy rare earth element.

The raw material alloys are separately or jointly crushed. The crushing process is generally divided into a crushing step and a pulverizing step.

First, in the crushing step, the raw material alloys are crushed until the particle size becomes approximately a few hundred μm. The crushing is preferably carried out with a stamp mill, a jaw crusher, a Brown mill or the like in an inert gas atmosphere. For the purpose of improving the crushing performance, it is effective to carry out the crushing after the treatment of hydrogen absorption and release.

After the crushing step, the pulverizing step is carried out. Crushed powders having particle sizes of approximately a few hundred μm are pulverized until the mean particle size becomes 3 to 8 μm. It is to be noted that a jet mill can be used for the pulverizing.

When the raw material alloys are separately pulverized in the pulverizing step, the pulverized raw material alloy powders are mixed together in a nitrogen atmosphere. The mixing ratio between the raw material alloy powders can be selected within a range from 50:50 to 97:3 in terms of weight ratio. This is also the case for the mixing ratio when the raw material alloys are jointly pulverized. The addition of an additive such as zinc stearate or oleic acid amide in a content of approximately 0.01 to 0.3 wt % at the time of the pulverizing enables to improve the orientation at the time of compacting.

Next, the mixed powder of the raw material alloys is subjected to compacting in a magnetic field. The compacting in a magnetic field may be carried out in a magnetic field of 12 to 17 kOe (960 to 1360 kA/m) under a pressure of approximately 0.7 to 2.0 ton/cm$^2$ (70 to 200 MPa).

After the compacting in a magnetic field, the compacted body thus obtained is sintered under a vacuum or in an inert gas atmosphere. The sintering temperature is needed to be regulated according to the various conditions such as variations of the composition, the crushing method, the particle size and the particle size distribution; the sintering may be carried out at 1000 to 1150° C. for approximately one to 5 hours.

In order to reduce the contents of the impurities, in particular, the oxygen content for the purpose of enhancing the properties, the production may be carried out by controlling the oxygen concentration at approximately 100 ppm in the course of from hydrogen crushing to placing in a sintering furnace.

After sintering, the obtained sintered body can be subjected to an aging treatment. This step is an important step for the purpose of controlling the coercive force. When the aging treatment is conducted as divided into two steps, effective are a retention at the vicinity of 800° C. and a retention at the vicinity of 600° C., respectively, for a predetermined period of time. The heat treatment at the vicinity of 800° C. conducted after sintering increases the coercive force, and is thereby particularly effective in the mixing method. Additionally, the heat treatment at the vicinity of 600° C. largely increases the coercive force; accordingly, when the aging treatment is conducted in a single step, it is recommendable to conduct an aging treatment at the vicinity of 600° C.

EXAMPLE 1

The two raw material alloys (first alloy and second alloy) shown in the row a in Table 1 were prepared in an Ar atmosphere by high frequency dissolution.

The first alloy and the second alloy thus prepared were mixed together in a weight ratio of 50:50; thereafter, the mixture thus obtained was made to absorb hydrogen at room temperature, and then subjected to a dehydrogenation treatment in an Ar atmosphere at 600° C. for one hour. Then, the mixture was crushed in a nitrogen atmosphere with a Brown mill.

The crushed powders thus obtained were added with zinc stearate as a crushing agent in a content of 0.05%. Then, the crushed powders were pulverized with a jet mill by using high-pressure nitrogen gas to obtain pulverized powders having a mean particle size of 4.5 μm.

The fine powders thus obtained were compacted to obtain a compacted body in a magnetic field of 15 kOe (1200 kA/m) under a pressure of 1.5 ton/cm$^2$ (150 MPa). The compacted body thus obtained was sintered in a vacuum under any one set of the various sets of conditions shown in Table 2, and then quenched. Then, the sintered body thus obtained was subjected to a two-step aging treatment consisting of an aging step of 850° C.×one hour and an aging step of 600° C.×one hour (both steps in an Ar atmosphere).

Each of the sintered bodies thus obtained was subjected to the measurements of the residual magnetic flux density (Br) and the coercive force (HcJ) by using a B-H tracer. The result of a composition analysis of each of the sintered magnets was found to be 20% Nd-5% Pr-5% Dy-2% Co-0.1% Cu-1% B-bal.Fe.

Figure 3:
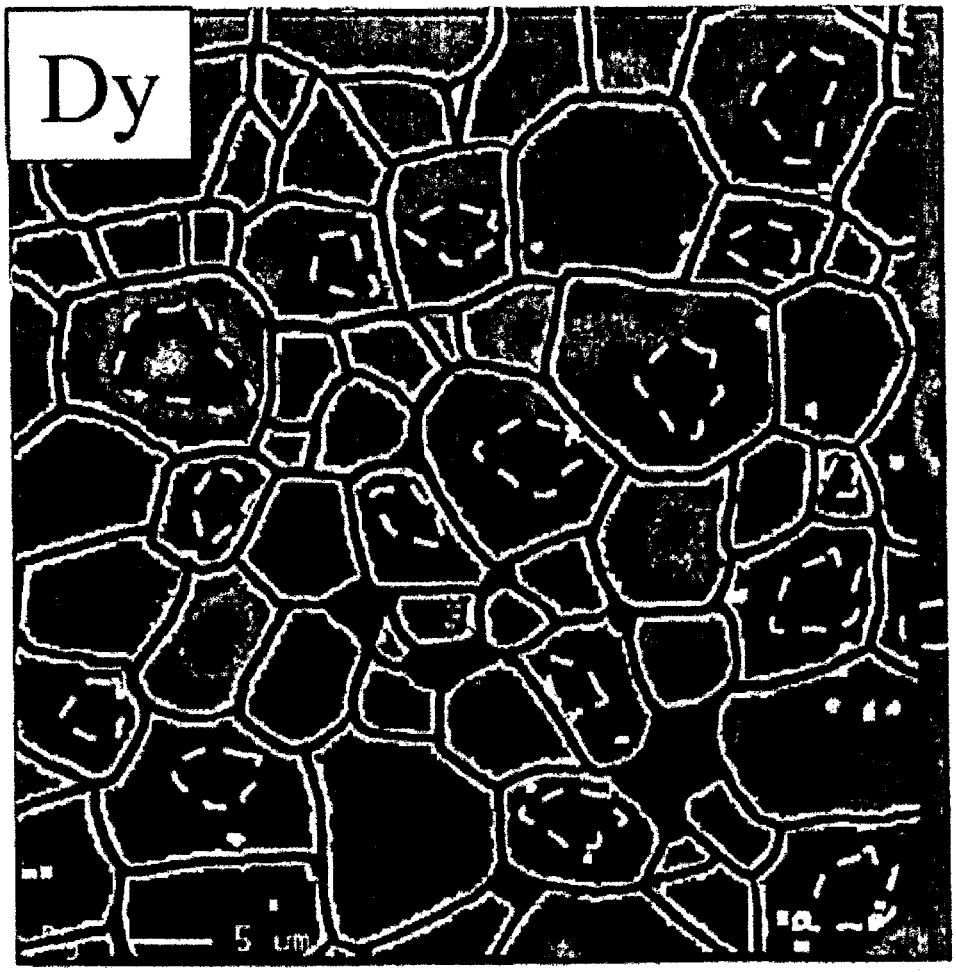
FIG. 3 shows the result of the element mapping carried out in a section of a sintered body obtained in Example 1 by using EPMA.

Additionally, a section of each of the obtained sintered bodies was subjected to an element mapping by using EPMA (Electron Prove Micro Analyzer) over an area range of 100 μm×100 μm. An example of the results of the element mapping is shown in FIG. 3. It is to be noted that FIG. 3 shows a view with grain boundary drawn over the EPMA element mapping diagram. The grain boundary can be identified on the basis of the contrast difference on the element mapping diagram, and accordingly, the grain boundary is shown with a solid line drawn on the part identified as the grain boundary.

On the basis of the result of the element mapping, with the characteristic X-ray intensity of Dy in the periphery of the main phase grain as the Dy concentration reference, the part with the Dy concentration decrease of less than 10% is defined as the outer shell part, and the part with the Dy concentration decrease of 10% or more is defined as the inner shell part. In FIG. 3, a dotted line is drawn on the boundary between the inner shell part and the outer shell part. As shown in FIG. 3, in addition to the main phase grains each having a structure comprising the inner shell part and the outer shell part, there are main phase grains having no such structure. Additionally, there are such main phase grains each having a structure in which the Dy concentration is higher in the central part.

For each of the sintered bodies subjected to observations as described above, a sample for the transmission electron microscope observation was prepared by using a FIB (Focused Ion Beam). From each of the samples thus prepared, 10 particles were randomly selected and were subjected to a mapping analysis and a quantitative analysis by means of EDS (Energy Dispersive X-ray Spectroscopy) using a transmission electron microscope. It is to be noted that although the quantitative analysis can be conducted with at least 10 particles, the quantitative analysis may also be conducted, needless to say, by selecting 10 or more particles. The quantitative analysis was carried out from the main phase grain periphery along a line toward a closest position of the inner shell part, identified from the mapping analysis result; thus, the inner shell part is defined as a part inside a position from which the decrease of the Dy concentration is 10% or more as compared to the periphery, and the shortest distance (L) from the periphery to the above-mentioned position was determined. On the other hand, from the sectional area of the main phase grain having the inner shell part and the outer shell part, the equivalent diameter (r) was determined, and the L/r was calculated for the above-mentioned main phase grain. Thus, the average value $(L/r)_{ave}$ of the L/r for each of the sintered bodies was determined. The results thus obtained are shown in Table 1. Additionally, FIG. 4 shows the relation between the $(L/r)_{ave}$ and the residual magnetic flux density (Br) and the relation between the $(L/r)_{ave}$ and the coercive force (HcJ).

Figure 4:
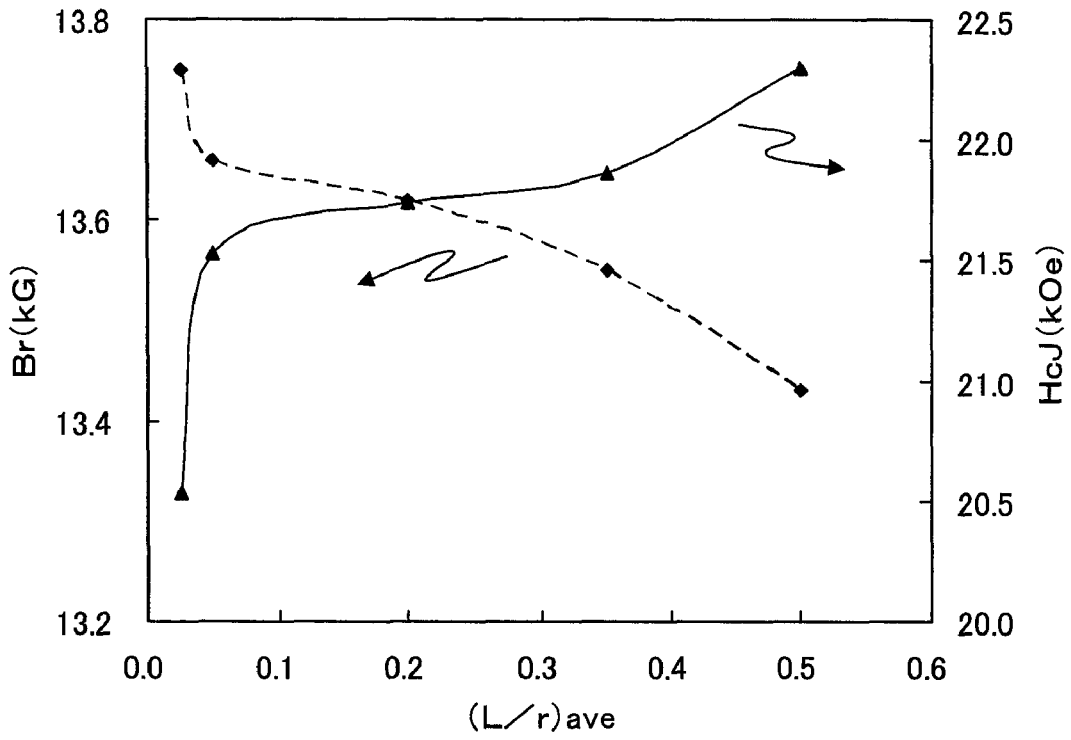
FIG. 4 is a graph showing a relation between $(L/r)_{ave}$ and the residual magnetic flux density (Br) and the relation between $(L/r)_{ave}$ and the coercive force (HcJ) in the sintered bodies obtained in Example 1.

As shown in Table 2 and FIG. 4, the coercive force (HcJ) decreases with decreasing $(L/r)_{ave}$, and on the contrary, the residual magnetic flux density (Br) decreases with increasing $(L/r)_{ave}$. When the $(L/r)_{ave}$ falls within a range from 0.03 to 0.40, the residual magnetic flux density (Br) and the coercive force (HcJ) exhibit high values. The $(L/r)_{ave}$ is preferably 0.06 to 0.30 and more preferably 0.10 to 0.25.

TABLE 1

| Raw material alloys | | Nd | Pr | Dy | Co | Cu | B | Fe | wt % Mixing ratio |
|---|---|---|---|---|---|---|---|---|---|
| a | First alloy | 25 | 5 | 0 | 2 | 0.1 | 1 | Bal | 50 |
| | Second alloy | 15 | 5 | 10 | 2 | 0.1 | 1 | Bal | 50 |
| b | First alloy | 23.5 | 5 | 1.5 | 2 | 0.1 | 1 | Bal | 50 |
| | Second alloy | 16.5 | 5 | 8.5 | 2 | 0.1 | 1 | Bal | 50 |
| c | First alloy | 22 | 5 | 3 | 2 | 0.1 | 1 | Bal | 50 |
| | Second alloy | 18 | 5 | 7 | 2 | 0.1 | 1 | Bal | 50 |
| d | First alloy | 20 | 5 | 5 | 2 | 0.1 | 1 | Bal | 50 |
| | Second alloy | 20 | 5 | 5 | 2 | 0.1 | 1 | Bal | 50 |

TABLE 2

| Sample No. | $(L/r)_{ave}$ | Br (kG) | HcJ (kOe) | Sintering temperature (° C.) | Sintering time (hr) |
|---|---|---|---|---|---|
| 1 | 0.025 | 13.75 | 20.53 | 1010 | 4 |
| 2 | 0.05 | 13.66 | 21.53 | 1020 | 4 |
| 3 | 0.20 | 13.62 | 21.74 | 1020 | 6 |
| 4 | 0.35 | 13.55 | 21.86 | 1030 | 4 |
| 5 | 0.45 | 13.43 | 22.30 | 1050 | 4 |

EXAMPLE 2

Sintered magnets were prepared by the same process as in Example 1 except that the four types of raw material alloys (first alloy and second alloy) a to d having the compositions shown in Table 1 were prepared and the sintering conditions were set such that 1020° C.×6 hours.

Each of the sintered bodies thus obtained was subjected to the measurements of the residual magnetic flux density (Br) and the coercive force (HcJ). The result of a composition analysis of each of the sintered magnets was found to be 20% Nd-5% Pr-5% Dy-2% Co-0.1% Cu-1% B-bal.Fe.

Additionally, the main phase grains of each of the sintered bodies thus obtained were subjected, in the same manner as in Example 1, to the element mapping analysis by means of EPMA and to the element mapping analysis and the quantitative analysis by means of EDS using a transmission electron microscope. Further, on the basis of the results of the EPMA mapping analysis, the number of the main phase grains and the number of the grains each having the core-shell structure, contained within the range of a 100 μm×100 μm observation viewing field were determined, and the number proportion of the grains each having the core-shell structure was calculated.

Figure 5:
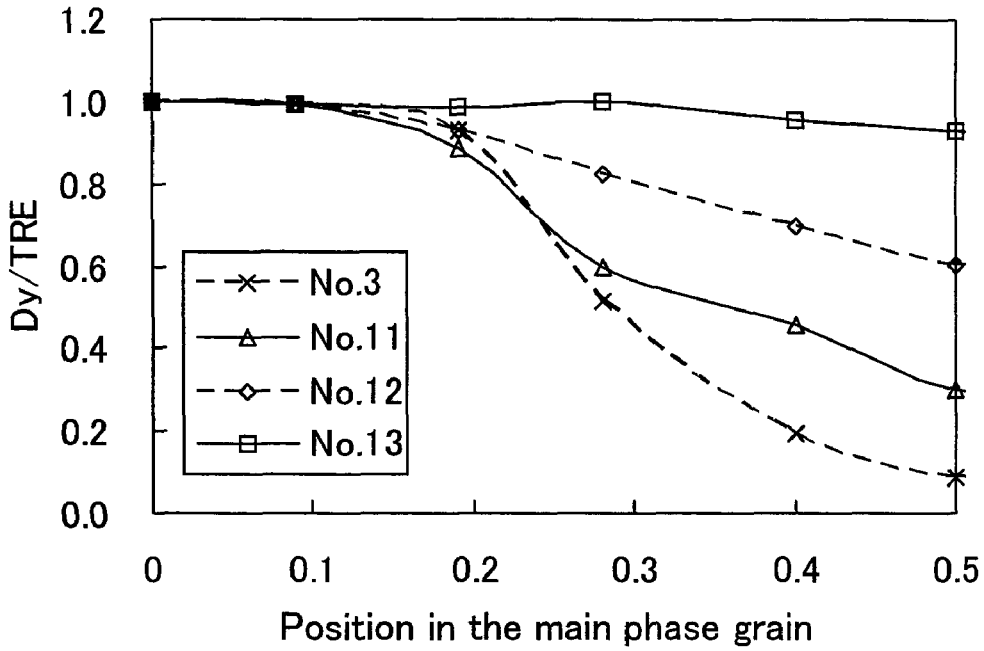
FIG. 5 is a graph showing the concentration distributions (Dy/TRE) of Dy (a heavy rare earth element) in relation to the total amount (TRE) of the rare earth elements of the sintered bodies obtained in Example 2.

FIG. 5 shows the concentration distributions (Dy/TRE) of Dy (the heavy rare earth element) in relation to the total amount (TRE) of the rare earth elements in the main phase grains. The horizontal axis of FIG. 5 represents the position in the main phase grain in such a way that "0" denotes the periphery (or the outermost surface) of the main phase grain and "0.5" denotes the center in the main phase grain. As described above, these concentration distributions each are an average value over 10 or more of the main phase grains each having a structure comprising the inner shell part and the outer shell part of the present invention.

Figure 6:
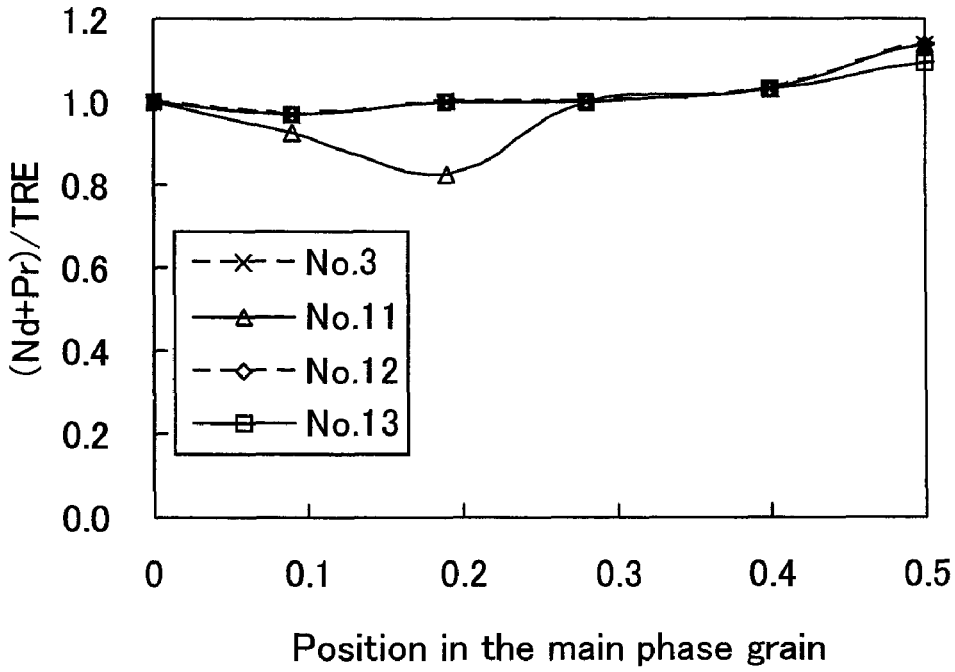
FIG. 6 is a graph showing the concentration distributions ((Nd+Pr)/TRE) of Nd and Pr (light rare earth elements) in relation to the total amount (TRE) of the rare earth elements of the sintered bodies obtained in Example 2.

Additionally, the vertical axis represents the concentration with an index defined to be unity in the periphery of the main phase grain. Therefore, for example, "0.8" indicates that the Dy concentration is smaller by 20% than the concentration in the periphery. Similarly, FIG. 6 shows the concentration distributions ((Nd+Pr)/TRE) of Nd+Pr (light rare earth elements) in relation to the total amount (TRE) of the rare earth elements. Additionally, Table 3 shows the Dy/TRE values and the (Nd+Pr)/TRE values at the central positions of the main phase grains.

As shown in Table 3 and FIGS. 5 and 6, by varying the proportions of the light rare earth elements (Nd, Pr) and the heavy rare earth element (Dy) in the raw material alloys (first alloy and second alloy), the concentration distributions of the light rare earth elements (Nd, Pr) and the heavy rare earth element (Dy) in the main phase grain can be varied. In other words, in any sample, the light rare earth elements (Nd, Pr) increase in the concentration thereof toward the center of the main phase grain, and on the contrary, the heavy rare earth element (Dy) decreases in the concentration thereof toward the center of the main phase grain; in particular, the concentration difference of the heavy rare earth element (Dy) in the main phase grain can be largely varied.

In relation to the magnetic properties, when the Dy concentration difference in the main phase grain becomes larger, the residual magnetic flux density (Br) becomes larger, and when the Dy concentration difference in the main phase grain becomes smaller, the coercive force (HcJ) becomes larger. When the Dy concentration at the center of the main phase grain is "0.93" and hence the Dy concentration difference is small as in Sample No. 13, it is meant that the main phase grain does not have the core-shell structure of the present invention, and the residual magnetic flux density (Br) is decreased. In the present invention taking as its object the simultaneous possession of the residual magnetic flux density (Br) and the coercive force (HcJ), the Dy concentration at the center of the main phase grain preferably falls within a range from 20 to 95%, more preferably within a range from 20 to 70% and most preferably within a range from 20 to 50% of the Dy concentration in the periphery of the main-phase grain.

TABLE 3

| Sample No. | Type | Raw material alloys: contents of rare earth elements (wt %) Nd | Pr | Dy | $(L/r)_{ave}$ | Dy/TRE | Nd + Pr/TRE | Br (kG) | HcJ (kOe) | Core-shell proportion (%) |
|---|---|---|---|---|---|---|---|---|---|---|
| 3 | First alloy | 25 | 5 | 0 | 0.20 | 0.09 | 1.14 | 13.62 | 21.74 | 65 |
| | Second alloy | 15 | 5 | 10 | | | | | | |

TABLE 3-continued

| Sample No. | Raw material alloys: contents of rare earth elements (wt %) Type | Nd | Pr | Dy | $(L/r)_{ave}$ | Dy/TRE | Nd + Pr/TRE | Br (kG) | HcJ (kOe) | Core-shell proportion (%) |
|---|---|---|---|---|---|---|---|---|---|---|
| 11 | First alloy | 23.5 | 5 | 1.5 | 0.19 | 0.30 | 1.14 | 13.51 | 22.50 | 73 |
| | Second alloy | 16.5 | 5 | 8.5 | | | | | | |
| 12 | First alloy | 22 | 5 | 3 | 0.20 | 0.60 | 1.14 | 13.48 | 23.10 | 82 |
| | Second alloy | 18 | 5 | 7 | | | | | | |
| 13 | First alloy | 20 | 5 | 5 | 0.00 | 0.93 | 1.09 | 13.33 | 23.50 | 0 |
| | Second alloy | 20 | 5 | 5 | | | | | | |

EXAMPLE 3

Sintered magnets were prepared by the same process as in Example 1 except that the three types of raw material alloys (first alloy and second alloy) e to g shown in Table 4 were prepared, the first alloy and the second alloy in each of the raw material alloys were mixed together in the weight ratio shown in Table 4, and thereafter the sintering conditions were set such that 1050° C.×4 hours. The result of a composition analysis of each of the sintered magnets thus obtained was found to be 30% Nd-2% Dy-2% Co-0.4% Cu-0.2% Al-0.19% Zr-1% B-bal.Fe.

Figure 7:
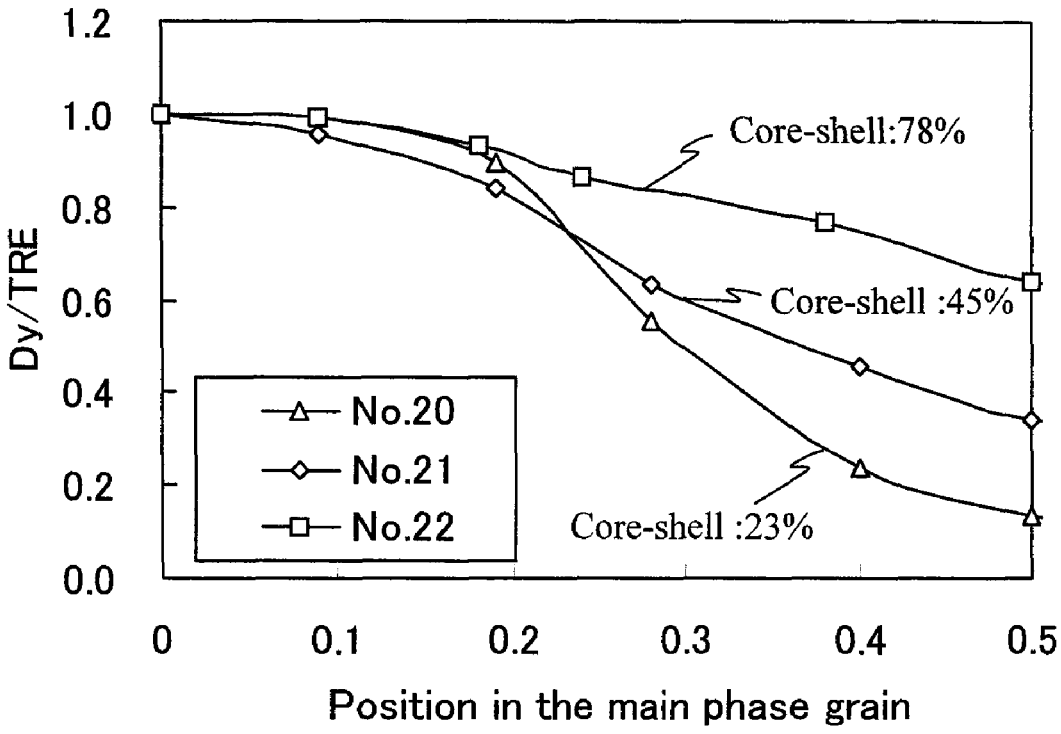
FIG. 7 is a graph showing the concentration distributions (Dy/TRE) of Dy (a heavy rare earth element) in relation to the total amount (TRE) of the rare earth elements of the sintered bodies obtained in Example 3.

The obtained sintered bodies were subjected to the same measurements as in Example 2 and a measurement of the squareness ratio (Hk/HcJ). The results thus obtained are shown in Table 5. Additionally, FIG. 7 shows the concentration distributions (Dy/TRE) of Dy (the heavy rare earth element) in relation to the total amount (TRE) of the rare earth elements. Here, Hk represents the external magnetic field intensity at which the magnetic flux density becomes 90% of the residual magnetic flux density in the second quadrant on the magnetic hysteresis loop.

It can be seen that as shown in Table 5 and FIG. 7, with the decrease of the Dy concentration difference, the proportion of the main phase grains each having the inner shell part and the outer shell part is increased. When the Dy concentration difference is small, the squareness ratio (Hk/HcJ) is increased. Accordingly, when a particularly high squareness ratio (Hk/HcJ) is demanded, and the residual magnetic flux density (Br) and the coercive force (HcJ) are intended to be obtained at the same time, the proportion of the main phase grains having the core-shell structure of the present invention preferably falls within a range from 60 to 90%.

TABLE 4

| | Raw material alloys | Nd | Dy | Co | Cu | B | Al | Zr | Fe | wt % Mixing ratio |
|---|---|---|---|---|---|---|---|---|---|---|
| e | First alloy | 30 | 0 | 0 | 0 | 1.25 | 0.2 | 0.24 | Bal | 80 |
| | Second alloy | 30 | 10 | 10 | 2 | 0 | 0.2 | 0 | Bal | 20 |
| f | First alloy | 29.9 | 1.1 | 0 | 0 | 1.11 | 0.2 | 0.21 | Bal | 90 |
| | Second alloy | 30 | 10 | 20 | 4 | 0 | 0.2 | 0 | Bal | 10 |
| g | First alloy | 30 | 1.6 | 0 | 0 | 1.06 | 0.2 | 0.2 | Bal | 95 |
| | Second alloy | 30 | 10 | 40 | 8 | 0 | 0.2 | 0 | Bal | 5 |

TABLE 5

| Sample No. | Core-shell proportion (%) | $(L/r)_{ave}$ | Dy/TRE | Nd/TRE | Br (kG) | HcJ (kOe) | Hk/HcJ (%) |
|---|---|---|---|---|---|---|---|
| 20 | 23 | 0.31 | 0.13 | 1.14 | 13.47 | 18.02 | 89.4 |
| 21 | 45 | 0.22 | 0.34 | 1.12 | 13.36 | 17.95 | 93.3 |
| 22 | 78 | 0.14 | 0.64 | 1.14 | 13.33 | 18.44 | 96.5 |

EXAMPLE 4

Sintered magnets were prepared by the same process as in Example 1 except that the three types of raw material alloys (first alloy and second alloy) h to j shown in Table 6 were prepared, the first alloy and the second alloy in each of the raw material alloys were mixed together in the weight ratio shown in Table 6, and thereafter the sintering conditions were set such that 1050° C.×4 hours. The result of a composition analysis of each of the sintered magnets thus obtained was found to be 21.2% Nd-9% Dy-0.6% Co-0.3% Cu-0.2% Al-0.17% Ga-1% B-bal.Fe.

The obtained sintered bodies were subjected to the same measurements as in Example 2. The results thus obtained are shown in Table 7. As shown in Table 7, in accordance with the present invention, magnets having the residual magnetic flux density (Br) and the coercive force (HcJ) at the same time were able to be obtained.

TABLE 6

| | Raw material alloys | Nd | Dy | Co | Cu | B | Al | Ga | Fe | wt % Mixing ratio |
|---|---|---|---|---|---|---|---|---|---|---|
| h | First alloy | 25 | 3.5 | 0 | 0 | 1.18 | 0.2 | 0.2 | Bal | 85 |
| | Second alloy | 0 | 40 | 4 | 2 | 0 | 0.2 | 0 | Bal | 15 |
| i | First alloy | 23.6 | 4.7 | 0 | 0 | 1.11 | 0.2 | 0.19 | Bal | 90 |
| | Second alloy | 0 | 48 | 6 | 3 | 0 | 0.2 | 0 | Bal | 10 |
| j | First alloy | 21.9 | 7.4 | 0 | 0 | 1.03 | 0.2 | 0.18 | Bal | 97 |
| | Second alloy | 0 | 60 | 20 | 10 | 0 | 0.2 | 0 | Bal | 3 |

TABLE 7

| Sample No. | Core-shell proportion (%) | $(L/r)_{ave}$ | Br (kG) | HcJ (kOe) |
|---|---|---|---|---|
| 30 | 54 | 0.32 | 11.6 | 32.1 |
| 31 | 72 | 0.24 | 11.5 | 32.6 |
| 32 | 85 | 0.1 | 11.4 | 33.0 |

The invention claimed is:

1. An R-T-B system sintered magnet comprising a sintered body comprising, as a main phase of the sintered body, grains mainly comprising an $R_2T_{14}B$ compound and comprising at least one of Dy and Tb as a heavy rare earth element and at least one of Nd and Pr as a light rare earth element, the R-T-B system sintered magnet being characterized in that:

the sintered body has a composition comprising R: 25 to 37 wt %, B: 0.5 to 2.0 wt %, Co: 3.0 wt % or less, Al: 0.03 to 0.30 wt %, Cu: 0.01 to 0.15 wt %, and the balance: Fe and inevitable impurities, wherein R represents the heavy rare earth elements in an amount of 0.1 to 10 wt %;

the sintered body comprises the grains each having a core-shell structure consisting of a single inner shell part and a single outer shell part surrounding the inner shell part;

the concentration of the heavy rare earth element in the inner shell part is 20 to 95% of the concentration of the heavy rare earth element in the periphery of the outer shell part;

in the grains each comprising the inner shell part and the outer shell part, $(L/r)_{ave}$ falls within a range from 0.10 to 0.25; and in a section thereof, the proportion of the number of the grains each having the core-shell structure to the total number of the grains forming the sintered body is 20% or more; wherein:

R represents one or more rare earth elements inclusive of Y;

T represents one or more transition metal elements wherein Fe or Fe and Co are essential;

L represents the shortest distance from the periphery of the grain to the inner shell part;

r represents the equivalent diameter of the grain; and $(L/r)_{ave}$ represents the average value of L/r for the grains, present in the sintered body, having the core-shell structure.

2. The R-T-B system sintered magnet according to claim 1, characterized in that the concentration of the light rare earth element is higher in the inner shell part than in the periphery of the outer shell part.

3. The R-T-B system sintered magnet according to claim 1, characterized in that the $(L/r)_{ave}$ is 0.06 to 0.30.

4. The R-T-B system sintered magnet according to claim 1, characterized in that the concentration of the heavy rare earth element in the inner shell part is 20 to 70% of the concentration of the heavy rare earth element in the periphery of the outer shell part.

5. The R-T-B system sintered magnet according to claim 1, characterized in that the concentration of the heavy rare earth element in the inner shell part is 20 to 50% of the concentration of the heavy rare earth element in the periphery of the outer shell part.

6. The R-T-B system sintered magnet according to claim 1, characterized in that, in a section thereof, the proportion of the number of the grains each having the core-shell structure to the total number of the grains forming the sintered body is 30 to 60%.

7. The R-T-B system sintered magnet according to claim 1, characterized in that, in a section thereof, the proportion of the number of the grains each having the core-shell structure to the total number of the grains forming the sintered body is 60 to 90%.

* * * * *